US012024811B2

(12) United States Patent
Park et al.

(10) Patent No.: US 12,024,811 B2
(45) Date of Patent: Jul. 2, 2024

(54) AIR INLET ASSEMBLY AND LAUNDRY TREATMENT APPARATUS INCLUDING THE SAME

(71) Applicant: LG ELECTRONICS INC., Seoul (KR)

(72) Inventors: Sung Hoo Park, Seoul (KR); Hyung Gyu Lim, Seoul (KR); Jae Hyung Kim, Seoul (KR); Minsu Woo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 397 days.

(21) Appl. No.: 17/307,452

(22) Filed: May 4, 2021

(65) Prior Publication Data

US 2021/0348320 A1 Nov. 11, 2021

(30) Foreign Application Priority Data

May 6, 2020 (KR) ..... 10-2020-0053910

(51) Int. Cl.
*D06F 58/10* (2006.01)
*D06F 58/20* (2006.01)
(Continued)

(52) U.S. Cl.
CPC ..... *D06F 58/10* (2013.01); *D06F 58/203* (2013.01); *D06F 58/22* (2013.01); *D06F 58/24* (2013.01)

(58) Field of Classification Search
None
See application file for complete search history.

(56) References Cited

U.S. PATENT DOCUMENTS

2005/0235677 A1 10/2005 Lee et al.
2010/0192397 A1 8/2010 Kim et al.
(Continued)

FOREIGN PATENT DOCUMENTS

CN 101622393 1/2010
CN 107109765 8/2017
(Continued)

OTHER PUBLICATIONS

KR 2011-0067754 translation, Cloth treating apparatus, Park, LG Electronics (Year: 2011).*
(Continued)

*Primary Examiner* — Cristi J Tate-Sims
(74) *Attorney, Agent, or Firm* — Fish & Richardson P.C.

(57) ABSTRACT

An air inlet assembly for circulating air in a receiving space for receiving laundry, and a laundry treatment apparatus including the same are provided. An air inlet assembly according to an aspect of the present disclosure includes a cover mounted on an air suction part, wherein the air suction part includes a through-hole formed in a portion thereof. The cover includes a base plate configured to cover the air suction part when viewed in a plan view, by forming a portion corresponding to the through-hole as an opened plate shape, an outer wall configured to continuously protrude along the periphery of the base plate, and a rib configured to protrude from an inner portion spaced apart from the outer wall so as to form a water discharge channel in a space between the outer wall and the rib, wherein the water discharge channel extends to the through-hole.

19 Claims, 10 Drawing Sheets

(51) Int. Cl.
*D06F 58/22* (2006.01)
*D06F 58/24* (2006.01)

(56) References Cited

U.S. PATENT DOCUMENTS

| | | | | |
|---|---|---|---|---|
| 2014/0238086 | A1 | 8/2014 | Choi et al. | |
| 2020/0080254 | A1* | 3/2020 | Chang | D06F 58/10 |

FOREIGN PATENT DOCUMENTS

| | | |
|---|---|---|
| CN | 209260402 | 8/2019 |
| EP | 3034679 | 6/2016 |
| KR | 10-2011-0067754 | 2/2017 |
| KR | 10-2020-0028184 | 3/2020 |
| TW | 202007812 | 2/2020 |

OTHER PUBLICATIONS

Extended European Search Report in European Appln. No. 21171961.2, dated Sep. 23, 2021, 6 pages.
Office Action in Chinese Appln. No. 202110446910.2, dated Apr. 1, 2023, 22 pages (with English translation).

* cited by examiner

AIR INLET ASSEMBLY AND LAUNDRY TREATMENT APPARATUS INCLUDING THE SAME

CROSS-REFERENCE TO RELATED APPLICATION

The present application claims benefit of priority to Korean Patent Application No. 10-2020-0053910, entitled "AIR INLET ASSEMBLY AND LAUNDRY TREATMENT APPARATUS INCLUDING THE SAME" filed on May 6, 2020, in the Korean Intellectual Property Office, the entirety of which is incorporated by reference herein.

FIELD

The present disclosure relates to an air inlet assembly and a laundry treatment apparatus including the same, and more particularly, to an air inlet assembly for circulating air in a receiving space for receiving laundry and a laundry treatment apparatus including the same.

BACKGROUND

Recently, various types of laundry treatment apparatuses such as washing machines for washing laundry have been developed and used.

For example, a drum-type dryer for drying washed laundry, a cabinet-type dryer for hanging and drying laundry, and a refresher for refreshing laundry by applying hot air to laundry have been developed. Here, the term "refresh" refers collectively to processes such as removing wrinkles from or deodorizing used laundry by applying heat and water to the used laundry.

In the case of a laundry treatment apparatus as described above, laundry can be treated by supplying hot air to a receiving space for receiving laundry. In addition, preferably, in order to increase treatment efficiency by using hot air, laundry can be treated through a circulation system that circulates and warms hot air supplied to the receiving space and then supplies it back to the receiving space.

With respect to a laundry treatment apparatus for treating laundry by circulating air in a receiving space for receiving laundry as described above, Korean Patent Publication No. 10-2011-0067754 (hereinafter referred to as 'Related Art 1') discloses a clothes treating apparatus.

Specifically, Related Art 1 discloses a configuration in which it is to possible remove foreign substances contained in air when circulating air to treat clothes, thereby preventing malfunction of mechanical devices caused by the foreign substances and improving product efficiency to increase a user's product satisfaction.

However, although the clothes treating apparatus disclosed in Related Art 1 may effectively remove the foreign substances contained in the circulated air, it does not take into account any configuration for effectively discharging condensed water generated in a receiving space for receiving clothes.

Condensed water due to a temperature difference may be generated in the clothes treating apparatus, and various clothes treating apparatuses using steam in particular are currently being developed. Considering this situation, it can be said that smoothly discharging condensed water generated in the receiving space is very important in order to improve product usability and durability.

Korean Patent Publication No. 10-2020-0028184 (hereinafter referred to as 'Related Art 2') also discloses a laundry treating apparatus.

Specifically, Related Art 2 discloses a configuration in which it is possible to withdraw a water discharge tank for collecting condensed water discharged from an air supply part that supplies air to a receiving space for receiving laundry, thereby increasing user convenience.

However, the laundry treating apparatus disclosed in Related Art 2 only considers a configuration for collecting condensed water generated in the receiving space and smoothly discharging the collected condensed water, and does not take into account any configuration for preventing the condensed water generated in the receiving space from flowing into unintended regions and causing deterioration in product functionality.

As such, while a laundry treatment apparatus for treating laundry by circulating air in a receiving space for receiving laundry is faced with the challenge of smoothly discharging condensed water generated in the receiving space, as described above, an existing air inlet assembly and a laundry treatment apparatus including the same cannot adequately address this challenge.

SUMMARY

The present disclosure is directed to addressing the above disadvantages of an air inlet assembly and a laundry treatment apparatus including the same.

Specifically, the present disclosure is directed to intensively guiding condensed water generated in a receiving space along a discharge path thereof such that the condensed water is not dispersed into unintended regions.

The present disclosure is further directed to allowing condensed water generated in a receiving space to smoothly flow along a discharge path and then be discharged, without flowing back through the discharge path.

The present disclosure is still further directed to effectively overcoming factors, such as surface tension, that may interfere with discharge of the condensed water generated in a receiving space.

The present disclosure is not limited to what has been disclosed hereinabove. A person skilled in the art may clearly understand, from the following description, other aspects not mentioned above.

In order to achieve the above or other objectives, an air inlet assembly and a laundry treatment apparatus including the same according to one aspect of the present disclosure may be configured to intensively guide condensed water generated in a receiving space along a discharge path. Specifically, a water discharge channel extending to a through-hole is formed in a space between a rib and an outer wall, which is formed in a cover.

An air inlet assembly and a laundry treatment apparatus including the same according to another aspect of the present disclosure may be configured to allow condensed water to smoothly flow along a discharge path, without flowing back through the discharge path. Specifically, a water discharge channel formed in the cover is inclined downward toward a through-hole.

An air inlet assembly and a laundry treatment apparatus including the same according to yet another aspect of the present disclosure may be configured to effectively overcome factors that may interfere with discharge of condensed water. Specifically, a slope is formed in both directions based on a coupling point between a water discharge channel and a through-hole in a cover, such that the coupling point is formed to be the lowest point.

In an air inlet assembly and a laundry treatment apparatus including the same according to yet another aspect of the present disclosure, a through-hole may be formed at one end of a cover having a rectangular plane, and a water discharge channel may be formed to extend from the other end of the cover to the through-hole.

In an air inlet assembly and a laundry treatment apparatus including the same according to yet another aspect of the present disclosure, a rib may be formed to protrude from a top surface of a cover so as to be lower than an outer wall.

In an air inlet assembly and a laundry treatment apparatus including the same according to yet another aspect of the present disclosure, a through-hole may be covered by a duct fastening part coupled to a cover.

In an air inlet assembly and a laundry treatment apparatus including the same according to yet another aspect of the present disclosure, a water discharge groove may be formed at a coupling point between a duct fastening part and a water discharge channel.

In an air inlet assembly and a laundry treatment apparatus including the same according to yet another aspect of the present disclosure, a filter may be stably mounted on a cover.

In an air inlet assembly and a laundry treatment apparatus including the same according to yet another aspect of the present disclosure, a support for a filter may be formed to extend along a water discharge channel.

In an air inlet assembly and a laundry treatment apparatus including the same according to yet another aspect of the present disclosure, a grill may be coupled on a cover so as to cover a filter.

In an air inlet assembly and a laundry treatment apparatus including the same according to yet another aspect of the present disclosure, a grill may be coupled on a cover such that the grill is supported by an outer wall.

In an air inlet assembly and a laundry treatment apparatus including the same according to yet another aspect of the present disclosure, a top surface of a grill may be formed to be recessed toward the inside the air inlet assembly.

The present disclosure is not limited to what has been disclosed hereinabove. A person skilled in the art may clearly understand, from the following description, other aspects not mentioned above.

An air inlet assembly and a laundry treatment apparatus including the same according to the present disclosure can provide the following advantages.

According to at least one of the embodiments of the present disclosure, since a water discharge channel extending to a through-hole is formed in a space between a rib and an outer wall, which is formed in a cover, it is possible to smoothly discharge condensed water generated in a receiving space, without the condensed water being dispersed into unintended regions.

In addition, according to at least one of the embodiments of the present disclosure, since a water discharge channel formed in a cover is inclined downward toward a through-hole, it is possible to smoothly discharge condensed water generated in a receiving space through a discharge path, without the condensed water flowing back through the discharge path.

In addition, according to at least one of the embodiments of the present disclosure, since a slope is formed in both directions based on a coupling point between a water discharge channel and a through-hole in a cover, such that the coupling point is formed to be the lowest point, it is possible to smoothly discharge condensed water with a high degree of collection even when discharge of the condensed water is interfered with by, for example, surface tension.

In addition, according to at least one of the embodiments of the present disclosure, since a through-hole is formed at one end of a cover having a rectangular plane and a water discharge channel extends from the other end of the cover to the through-hole, it is possible to increase discharge efficiency by relatively simplifying and unifying a discharge path of condensate water.

In addition, according to at least one of the embodiments of the present disclosure, since a rib protrudes from a top surface of a cover so as to be lower than an outer wall, it is possible to prevent condensed water flowing along a water discharge channel from scattering out of the cover.

In addition, according to at least one of the embodiments of the present disclosure, since a through-hole is covered with a duct fastening part coupled to a cover, it is possible to stably perform suction of air as well as discharge of condensate water through a stable coupling between the duct fastening part and a suction duct.

In addition, according to at least one of the embodiments of the present disclosure, since a water discharge groove is formed at coupling point between a duct fastening part and a water discharge channel, it is possible to cause condensed water collected through a water discharge channel to smoothly flow to a through-hole on which the duct fastening part is installed.

In addition, according to at least one of the embodiments of the present disclosure, since a filter is stably mounted on a cover, it is possible to filter foreign substances contained in sucked air or discharged condensed water.

In addition, according to at least one of the embodiments of the present disclosure, since a support for a filter extends along a water discharge channel, it is possible for the support for the filter to guide a flow path of condensed water flowing into the water discharge channel.

In addition, according to at least one of the embodiments of the present disclosure, since a grill covering a filter is coupled on a cover, it is possible to prevent the filter from being directly exposed to the outside and to improve exterior aesthetics.

In addition, according to at least one of the embodiments of the present disclosure, since a grill is coupled on a cover such that the grill is supported by an outer wall, it is possible to cause condensed water generated in a receiving space to flow into a gap between the grill and the outer wall through a capillary phenomenon.

In addition, according to at least one of the embodiments of the present disclosure, since a top surface of a grill is recessed toward the inside of the air inlet assembly, it is possible to collect condensed water present on a top surface of the grill into a center thereof and then discharge the collected condensed water.

Further scope of applicability of the present disclosure will become apparent from the detailed description given hereinafter. However, it would be obvious to those skilled in the art that various changes and modifications can be made without departing from the spirit and scope of the present disclosure.

DETAILED DESCRIPTION

Hereinafter, the embodiments disclosed in this specification will be described in detail with reference to the accompanying drawings. The detailed description of related known technology will be omitted when it may obscure the subject matter of the embodiments according to the present disclosure.

Figure 1:
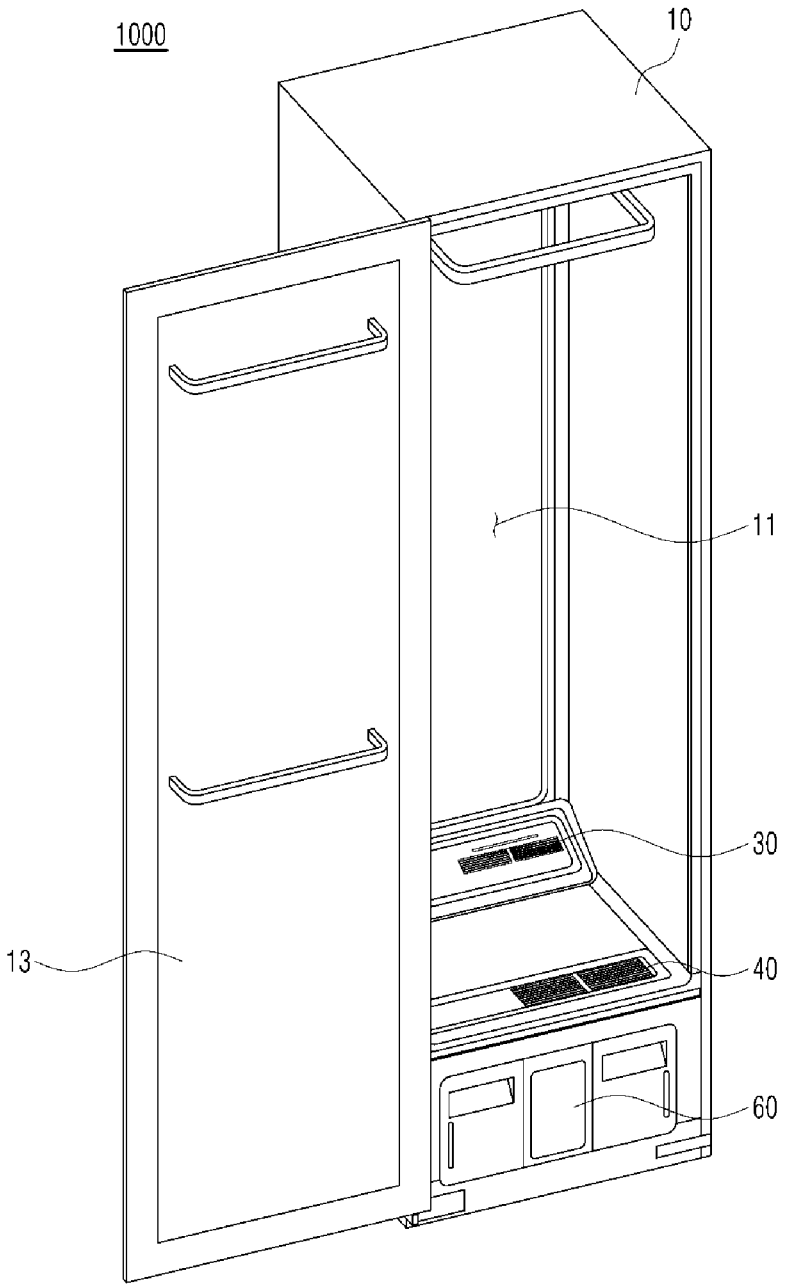
FIG. 1 is a perspective view illustrating a laundry treatment apparatus according to one embodiment of the present disclosure.
Figure 2:
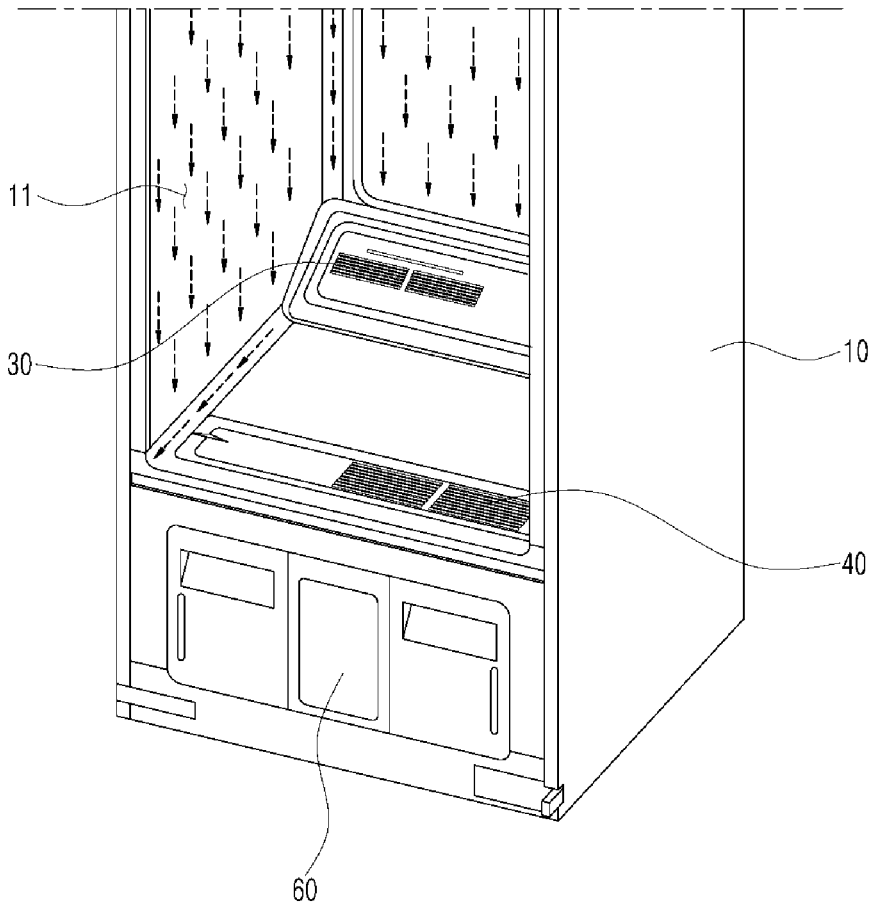
FIG. 2 is a view illustrating a state of condensed water generated in a receiving space in a laundry treatment apparatus according to one embodiment of the present disclosure.
Figure 3:
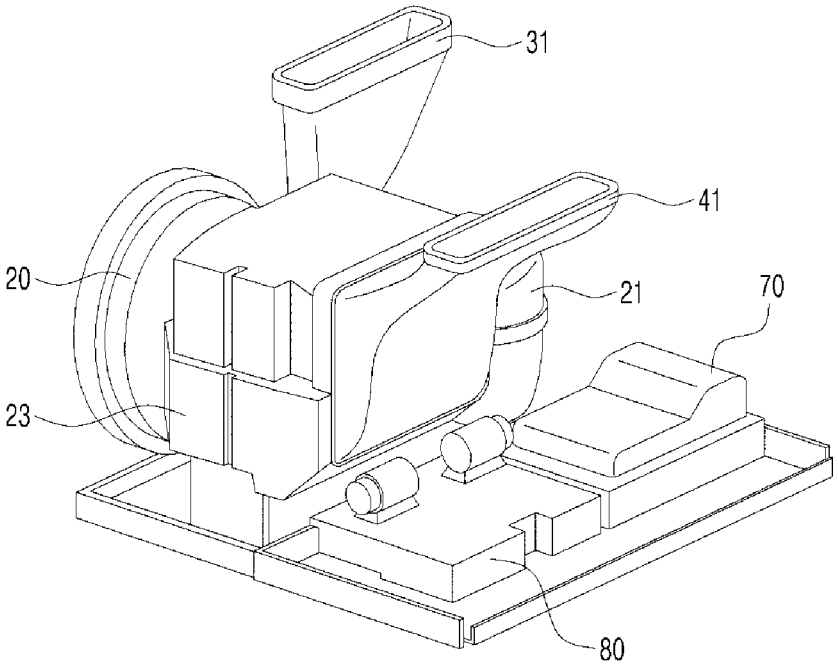
FIG. 3 is a perspective view illustrating a machine room in a laundry treatment apparatus according to one embodiment of the present disclosure.

FIG. 1 is a perspective view illustrating a laundry treatment apparatus according to one embodiment of the present disclosure. FIG. 2 is a view illustrating a state of condensed water generated in a receiving space in a laundry treatment apparatus according to one embodiment of the present disclosure. FIG. 3 is a perspective view illustrating a machine room in a laundry treatment apparatus according to one embodiment of the present disclosure.

Hereinafter, a laundry treatment apparatus 1000 according to one embodiment of the present disclosure will be described with reference to a refresher that refreshes laundry and applies hot air to the laundry. However, the laundry treatment apparatus 1000 is not limited thereto, and the idea of the present disclosure may be applied to other types of apparatuses that may include, for example, a heat pump.

Here, the term 'refresh' may refer to a process such as removing wrinkles from, deodorizing, sanitizing, preventing static electricity in, or warming laundry by applying, for example, air, hot air, water, mist, or steam to the laundry.

In addition, the term 'laundry' mentioned in this embodiment may refer to objects such as clothes, apparel, shoes, socks, gloves, hats, and shawls that may be worn by humans. The laundry may also refer to objects such as dolls, towels, and blankets that may be used by humans, as well as all objects that can be washed.

Referring to FIGS. 1 to 3, the laundry treatment apparatus 1000 according to one embodiment of the present disclosure may include a cabinet 10 forming an outer shape thereof, a receiving space 11 formed in the cabinet 10 to receive laundry, a hanger mounted at the inner upper part of the cabinet 10 to hold the laundry, an air supply device 20 configured to dehumidify and warm air so as to supply dry air and hot air to the receiving space 11, a water generation device 70 configured to selectively supply water and steam to the receiving space 11, and a controller configured to control the operation of individual components in association therewith.

The cabinet 10 is provided with a door 13 to close the receiving space 11 formed therein. A control panel for controlling the laundry treatment apparatus 1000 is provided on one side of the door 13, facing away from the receiving space 11. A controller for controlling individual components of the laundry treatment apparatus 1000 in association with the control panel is provided in the interior space formed by closing the door 13. A separate hanger for hanging the laundry may be provided on the other side of the door 13, facing the receiving space 11.

An air supply part 30 and an air suction part 40 are provided in the receiving space 11, wherein the air supply part 30 is configured to supply air and hot air from the air supply device 20 to the receiving space 11, and the air suction part 40 is configured to suck so as to circulate the air and hot air that was supplied from the air supply part 30 and used in treating in the laundry. The air supply part 30 and the air suction part 40 are respectively coupled to the air supply device 20 in a machine room 60 to be described below.

On the other hand, the machine room 60 having both the air supply device 20 and a water generation device 70 may be provided under the receiving space 11 in the cabinet 10. In this case, a door for the machine room 6 may be additionally provided to close the machine room 60, separately from the door 13.

The reason why the machine room 60 is located under the receiving space 11 is that, for example, hot air and steam supplied to the receiving space 11 have a property of rising, and it is thus preferable to spray the hot air and steam toward the upper portion of the receiving space 11 by locating the machine room 60 under the receiving space 11.

The air supply device 20 is located in the machine room 60, such that the air supply device 20 heats and dehumidifies air and then supplies hot air to the receiving space 11. At one side of the air supply device 20, the water generation device 70 is located to supply water. The air supply device 20 includes an evaporator, a compressor 21, a condenser, and a heat pump using an expansion valve, through which refrigerant circulates. It is possible to dehumidify and warm the air through the above components.

That is, it is possible to achieve dehumidification by allowing a refrigerant evaporating in the evaporator to absorb latent heat of the surrounding air so as to cool the air and by condensing water contained in the air. To this end, the water generation device 70 and a condensed water discharge device 80 are provided at one side of the air supply device 20, wherein the condensed water discharge device 80 is configured to collect and discharge the condensed water condensed in the air supply device 20 or to supply the condensed water back to the water generation device 70.

Describing the air supply device 20 in detail, the air supply device 20 includes a compressor 21 for compressing the refrigerant, a heat exchanger 23 through which the refrigerant condensed by the compressor 21 and air are heat-exchanged, a blowing duct 31 for supplying the air (or hot air) passing through the heat exchanger 23 to the receiving space 11, and a suction duct 41 for sucking the air present in the receiving space 11. Here, the blowing duct 31 and the suction duct 41 are respectively coupled to the air supply part 30 and the air suction part 40 in the receiving space 11, which are described above.

The air in the receiving space 11 flows into the heat exchanger 23 through the air suction part 40 and the suction duct 41 by the air supply device 20. The air flowing into the heat exchanger 23 is then dehumidified and warmed by the evaporator and the condenser in the heat exchanger 23. The warmed air is supplied to the receiving space 11 through the air supply part 30 by the blowing duct 31.

The water generation device 70 may supply steam to the receiving space 11 for receiving laundry so as to remove, for example, wrinkles from the laundry. Further, the water generation device 70 can achieve a sanitizing effect by high-temperature steam and a refreshing effect through, for example, swelling of laundry fabric.

The water generation device 70 includes a heater for warming water, and generates steam by heating water and then supplies the stem to the receiving space 11. An external faucet, or a container-type water supply tank provided at one side of the machine room 60 may be used as a water supply source for supplying water to the water generation device 70.

On the other hand, as illustrated in FIG. 2, in the process of treating laundry as described above, the condensed water may be generated due to a temperature difference, and in particular, a large amount of condensed water may be generated in the receiving space 11 when steam is used.

The condensed water may be discharged through the through-hole 43 of the air suction part 40, such that it is possible to maintain the interior of the receiving space 11 at a condition suitable for treating the laundry.

However, when the condensed water generated in various places in the receiving space 11 is not smoothly discharged through the through-hole 43 of the air suction part 40 and flows into the gap between the cabinet 10 and the door 13, there is a concern that water may leak to the outside of the laundry treatment apparatus 1000 due to damage to a sealing member.

Accordingly, the air inlet assembly 50 and the laundry treatment apparatus 1000 including the same according to one embodiment of the present disclosure is configured to allow the condensed water generated in the receiving space 11 to be smoothly discharged through the through-hole 43 of the air inlet part 40.

Figure 4:
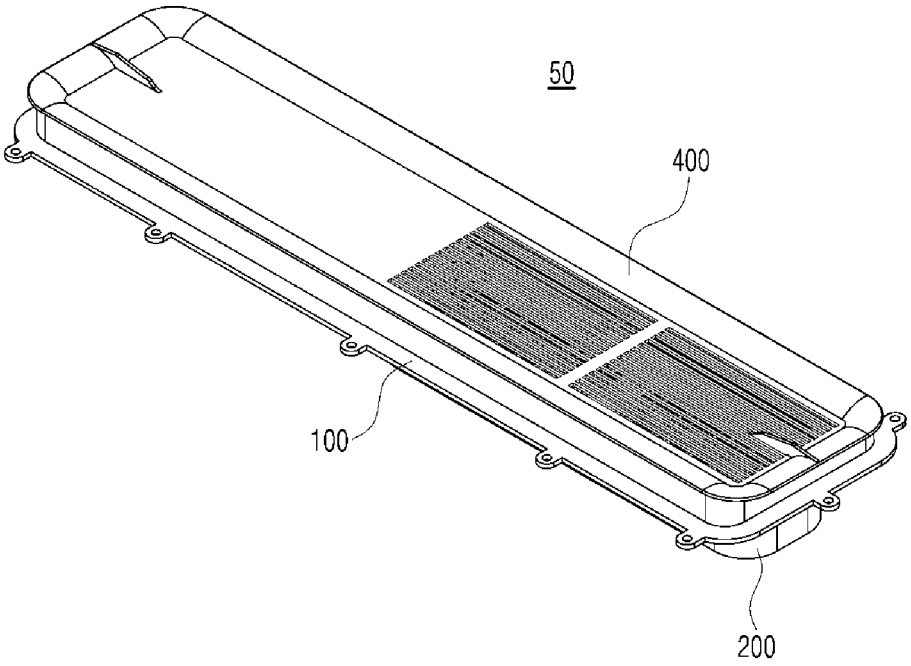
FIG. 4 is a perspective view illustrating an air inlet assembly in a laundry treatment apparatus according to one embodiment of the present disclosure.
Figure 5:
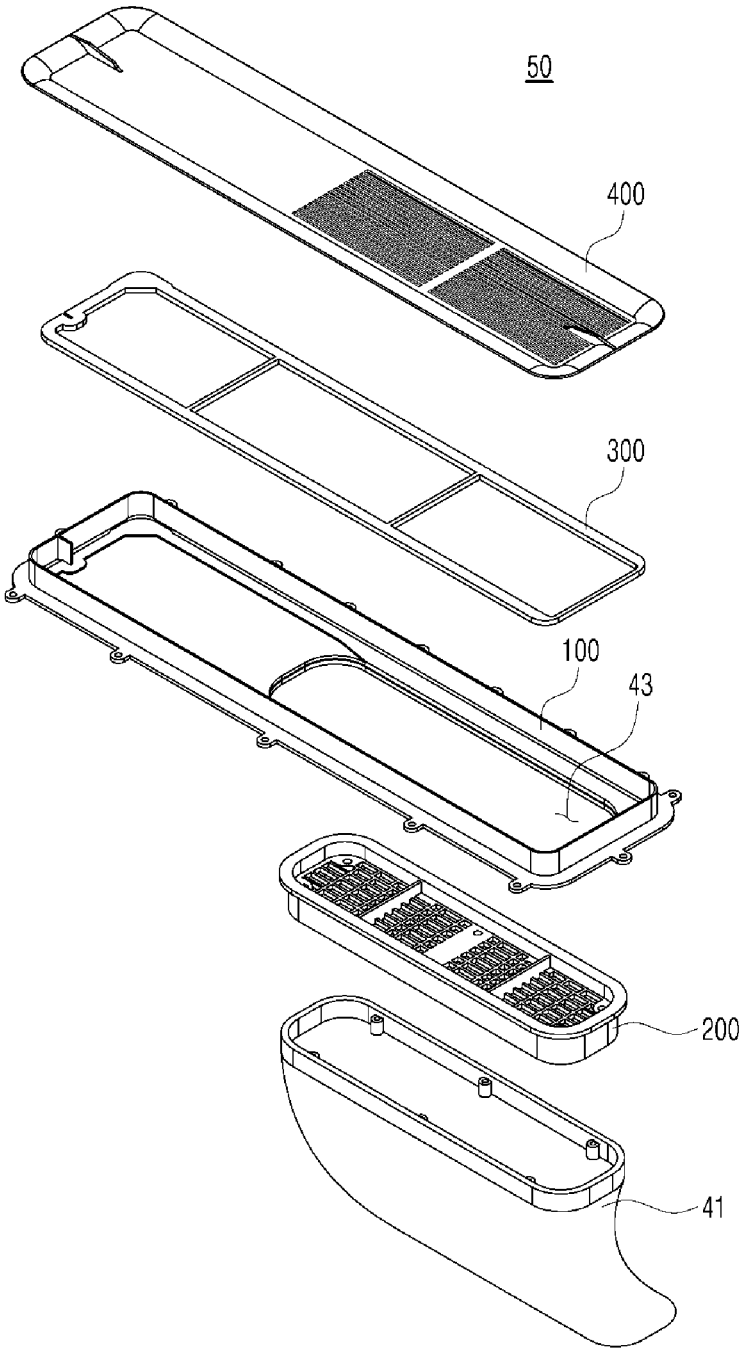
FIG. 5 is an exploded perspective view illustrating an air inlet assembly in a laundry treatment apparatus according to one embodiment of the present disclosure.

FIG. 4 is a perspective view illustrating the air inlet assembly in the laundry treatment apparatus according to one embodiment of the present disclosure. FIG. 5 is an exploded perspective view illustrating the air inlet assembly in the laundry treatment apparatus according to one embodiment of the present disclosure.

As illustrated in FIGS. 4 and 5, in the laundry treatment apparatus 1000 according to one embodiment of the present disclosure, the air inlet assembly 50 includes the cover 100. The air inlet assembly 50 may further include a duct fastening part 200, a filter 300, and a grill 400.

The air inlet assembly 50 includes the cover 100, which is mounted on the air suction part 40 including the through-hole 43 formed in a portion thereof. In addition, the air inlet assembly 50 may include the duct fastening part 200 fastened to the suction duct 41 that is coupled to and located under the cover 100, the filter 300 located on the air suction unit 40 to be stably mounted on the cover 100, and the grill 400 coupled to the air suction part 40 so as to fix the filter 300.

While air is sucked, the portion of the cover 100, corresponding to the through-hole 43 is opened such that the duct fastening part 200 and the suction duct 41 may be fastened to the upper portion and the lower portion of the cover, respectively. The cover 100 may be fixedly coupled inside the cabinet 10 by coupling members such as screws.

The duct fastening part 200 is a part that is coupled to the cover 100 by penetrating the cover 100 so as to cover the through-hole 43, and may be formed in a hollow tube shape such as a rectangular shape so as to be inserted into the through-hole 43. Further, the duct fastening part 200 may be fixed to the suction duct 41 by coupling members such as screws. On the inner circumferential surface of the duct fastening part 200, a catching protrusion for defining the position of the suction duct 41 may be formed to extend and bend downward.

Accordingly, in the air inlet assembly 50 and the laundry treatment apparatus 1000 including the same according to one embodiment of the present disclosure, since the through-hole 43 is covered with the duct fastening part 200 coupled to the cover 100, a stable coupling between the duct fastening part 200 and the suction duct 41 may be made, such that air suction and condensed water discharge may be stably performed.

The filter 300 is a part that is stably mounted on the cover 100 so as to filter the foreign substances introduced into the air suction part 40, and may be located on the duct fastening part 200 and may eventually be stably mounted on the cover 100 of the air suction part 40. The filter 300 may be formed of a body forming a frame thereof, and a mesh for filtering the foreign substances.

The filter 300 has an outer circumferential surface corresponding to the inner circumferential surface of the air suction part 40. A removal groove is recessed at one edge of the body of the filter 300 to facilitate attachment and detachment of the filter 300.

Accordingly, in the air inlet assembly 50 and the laundry treatment apparatus 1000 including the same according to one embodiment of the present disclosure, since the filter 300 is stably mounted on the cover 100, it is possible to filter the foreign substances contained in the sucked air or the discharged condensed water.

The grill 400 is a part that is coupled on the cover 100 so as to cover the filter 300, and may be installed in the air suction part 40 in the cabinet 10 and prevent the filter 300 from becoming separated. The grill 400 may be formed of a body forming a frame thereof, and a plurality of slits through which the air passes.

The grill 400 has an outer circumferential surface corresponding to the inner circumferential surface of the air suction part 40. The grill 400 may have a protruding elastic rib formed on one side thereof, and the protruding elastic rib may be disposed on the inner circumferential surface of the air suction portion 40 such that the grill 400 may be detachably coupled to the air suction portion 40.

Accordingly, in the air inlet assembly 50 and the laundry treatment apparatus 1000 including the same according to one embodiment of the present disclosure, since the grill 400 covering the filter 300 is coupled on the cover 100, it is possible to prevent the filter 300 from being directly exposed to the outside and to improve exterior aesthetics.

Figure 6:
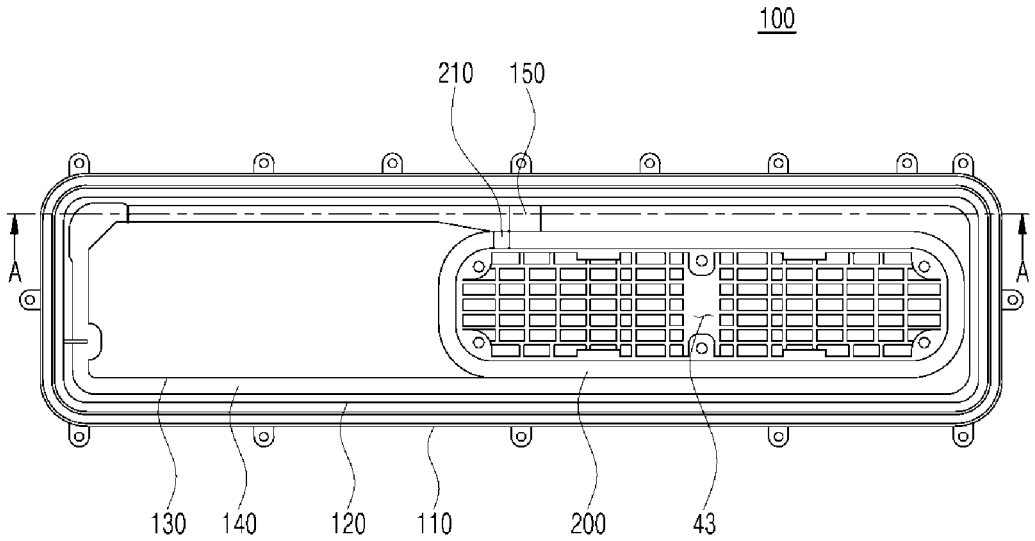
FIG. 6 is a plan view illustrating a cover of an air inlet assembly in a laundry treatment apparatus according to one embodiment of the present disclosure.
Figure 7:
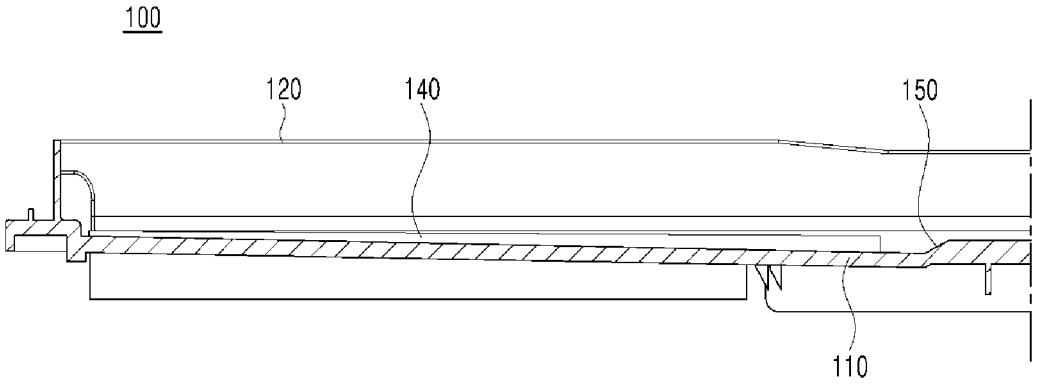
FIG. 7 is a cross-sectional view taken along line A-A shown in FIG. 6.
Figure 8:
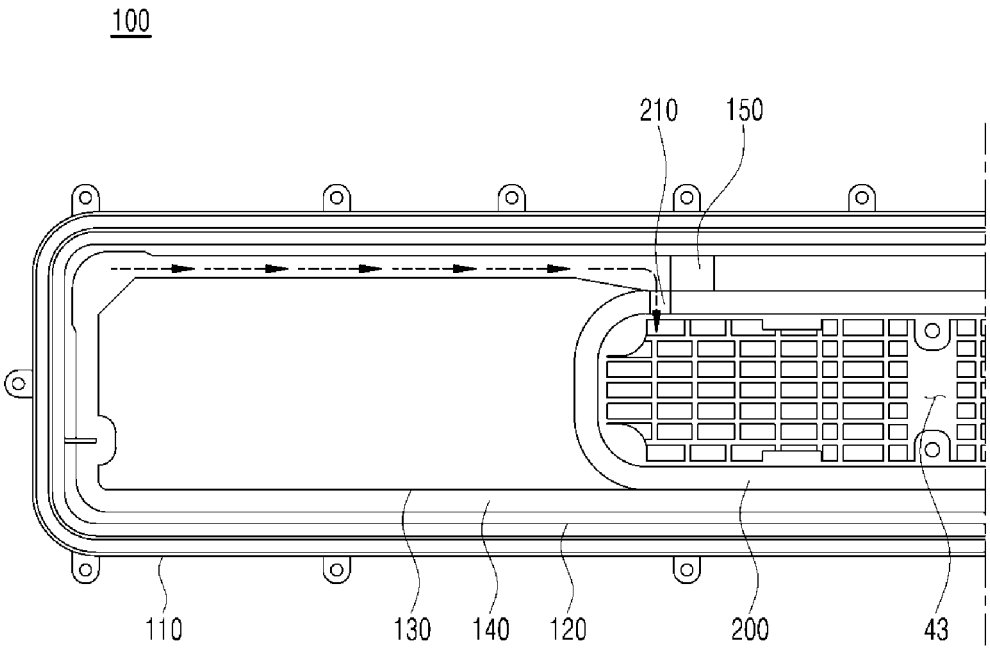
FIG. 8 is a view illustrating a path through which condensed water flows in the cover illustrated in FIG. 6.

FIG. 6 is a plan view illustrating the cover of the air inlet assembly in the laundry treatment apparatus according to one embodiment of the present disclosure. FIG. 7 is a cross-sectional view taken along line A-A shown in FIG. 6. FIG. 8 is a view illustrating a path through which condensed water flows in the cover illustrated in FIG. 6.

As illustrated in FIGS. 6 to 8, in the air inlet assembly 50 and the laundry treatment apparatus 1000 including the same according to one embodiment of the present disclosure, the cover 100 includes a base plate 110, an outer wall 120, and a rib 130.

The base plate 110 is a part that is formed in a plate shape having an opened portion corresponding to the through-hole 43 and covers the air suction part 40 when viewed in a plan view, and forms the entire exterior of the cover 100. At this time, in the state where the base plate 110 is covering the air suction part 40, the opened portion of the base plate 110 and the through-hole 43 may communicate with each other, and the duct fastening part 200 may be coupled to the opened portion.

The outer wall 120 is a portion that continuously protrudes along the periphery of the base plate 110, and the upper end of the outer wall 120 may correspond to or protrude slightly higher than the inner surface of the cabinet 10. Further, since the grill 400 is stably mounted on the outer wall 120, when viewed from the outside, a coupling state between the inner surface of the cabinet 10 and the grill 400 may be generally maintained.

On the other hand, the condensed water flowing along the inner surface of the cabinet 10 may flow toward the base plate 110 of the cover 100 to be discharged through the through-hole 43. In this case, the flowing condensed water may pass through the outer wall 120 of the cover 100, and may then be collected on the top surface of the base plate 110.

However, when the condensed water is dispersed over the entire top surface of the base plate 110, there is a concern that some of the condensed water may not flow to the through-hole 43, and remain on the top surface of the base plate 110. Therefore, it is not preferable that the condensed water is dispersed over the entire top surface of the base plate 110, and it is necessary to concentrate the discharge path of the condensed water to the through-hole 43.

To this end, the rib 130 protrudes from an inner portion spaced apart from the outer wall 120 so as to form a water discharge channel 140 in a space between the outer wall 120 and the rib 130, wherein the water discharge channel 140 extends to the through-hole 43.

That is, since the flowing condensed water is blocked by the rib 130 after passing through the outer wall 120 of the cover 100, it cannot flow to the central portion of the base plate 110. As a result, the condensed water flows to the through-hole 43 along the water discharge channel 140 corresponding to the space between the outer wall 120 and the rib 130.

As described above, in the air inlet assembly 50 and the laundry treatment apparatus 1000 including the same according to one embodiment of the present disclosure, since the water discharge channel 140 extending to the through-hole 43 is formed in the space between the outer wall 120 and the rib 130, which is formed in the cover 100, the condensed water generated in the receiving space 11 can be discharged smoothly without being dispersed into unintended regions.

In the air inlet assembly 50 and the laundry treatment apparatus 1000 including the same according to one embodiment of the present disclosure, the water discharge channel 140 is inclined downward toward the through-hole 43.

That is, referring to FIG. 7, since the left side of the water discharge channel 140 is higher than the right side corresponding to the portion having the through-hole 43, the water discharge channel 140 may be inclined.

Accordingly, the condensed water flowing into the water discharge channel 140 formed between the outer wall 120 and the rib 130 may only flow from the left side to the right side according to the inclination of the water discharge channel 140. As a result, the condensed water may always flow in a certain direction, without flowing back, along the water discharge channel 140.

As described above, in the air inlet assembly 50 and the laundry treatment apparatus 1000 including the same according to one embodiment of the present disclosure, since the water discharge channel 140 formed in the cover 100 is inclined downward toward the through-hole 43, it is possible to smoothly discharge the condensed water generated in the receiving space 11 through a discharge path, without the condensed water flowing back through the discharge path.

In the air inlet assembly 50 and the laundry treatment apparatus 1000 including the same according to one embodiment of the present disclosure, the cover 100 may further include a slope 150 inclined upward from a coupling point between the water discharge channel 140 and the through-hole 43.

That is, as illustrated in FIGS. 7 and 8, the water discharge channel 140 may be formed such that the coupling point between the water discharge channel 140 and the through-hole 43 is formed to be the lowest point, and the left side based on the coupling point has the inclination as described above.

In addition, since a slope 150 is formed at the right side based on the coupling point formed to be the lowest point, the condensed water cannot excessively flow to the right side after passing through the coupling point.

In particular, it is possible that the discharge of the condensed water through the through-hole 43 may be interfered with due to some of the condensed water adhering to the surface of the cover 100, for example, due to surface tension thereof. However, when the slope 150 is formed as described above, the condensed water may be gradually collected at the coupling point, and may flow to the through-hole 43 when the volume and weight of the collected condensed water reach an extent that is sufficient to overcome the surface tension.

As described above, in the air inlet assembly 50 and the laundry treatment apparatus 1000 including the same according to one embodiment of the present disclosure, since the slope 150 is formed in both directions based on the coupling point between the water discharge channel 140 and the through-hole 43 in the cover 100, such that the coupling point is formed to be the lowest point, it is possible to smoothly discharge the condensed water with a high degree of collection even when the discharge of the condensed water is interfered with by, for example, the surface tension.

In the air inlet assembly 50 and the laundry treatment apparatus 1000 including the same according to one embodiment of the present disclosure, the base plate 110 may be formed in a rectangular shape and the through-hole 43 may be disposed at one end thereof, and the water discharge channel 140 may extend from the other end of the base plate 110 to the through-hole 43.

That is, as illustrated in FIGS. 7 and 8, the through-hole 43 is disposed only at the right side of the base plate 110, and the water discharge channel 140 may extend from the left end of the base plate 110 to the through-hole 43.

Accordingly, the condensed water flowing into the cover 100 may always flow from the left side the base plate 110 to the right side, and may then be discharged through the through-hole 43.

As described above, in the air inlet assembly 50 and the laundry treatment apparatus 1000 including the same according to one embodiment of the present disclosure, since the through-hole 43 is formed at one end of the cover 100 having a rectangular plane and the water discharge channel 140 extends from the other end of the cover 100 to the through-hole 43, it is possible to increase discharge efficiency by relatively simplifying and unifying the discharge path of the condensate water.

In the air inlet assembly 50 and the laundry treatment apparatus 1000 including the same according to one embodiment of the present disclosure, the protruding height of the rib 130 may be formed to be relatively lower than the protruding height of the outer wall 120.

As described above, the condensed water may be guided to the through-hole 43 along the water discharge channel 140 formed between the outer wall 120 and the rib 130, but there is a concern that the capacity of the water discharge channel 140 may be exceeded when the amount of the collected condensed water becomes excessive.

In this case, the condensed water may overflow from the water discharge channel 140 and scatter to other regions of the cover 100. The scattering of the condensed water back into the receiving space 11 of the cabinet 10 may adversely affect the functioning of the laundry treatment apparatus 1000.

Accordingly, it may be preferable that the height of the rib 130 is formed to be lower than the height of the outer wall 120, such that the cover 100 receives the condensed water therein when the excessive condensed water overflows from the water discharge channel 140.

As described above, in the air inlet assembly 50 and the laundry treatment apparatus 1000 including the same according to one embodiment of the present disclosure, since the rib 130 protrudes from the top surface of the cover 100 so as to be lower than the outer wall 120, it is possible to prevent the condensed water flowing along the water discharge channel 140 from scattering out of the cover 100.

In the air inlet assembly 50 and the laundry treatment apparatus 1000 including the same according to one embodiment of the present disclosure, the duct fastening part 200 may include a water discharge groove 210 recessed at a coupling point between the duct fastening part 200 and the water discharge channel 140.

That is, as illustrated in FIG. 8, the duct fastening part 200 may be coupled on the through-hole 43. In addition, the water discharge groove 210 may be formed on the top surface of the duct fastening part 200 so as to be coupled to the coupling point between the through-hole 43 and the water discharge channel 140.

Accordingly, the condensate flowing to the lowest region may flow naturally along the water discharge groove 210 at the coupling point between the water discharge channel 140 and the through-hole 43, and may then flow to the through-hole 43.

As described above, in the air inlet assembly 50 and the laundry treatment apparatus 1000 including the same according to one embodiment of the present disclosure, since the water discharge groove 210 is formed at the coupling point between the duct fastening part 200 and the water discharge channel 140, it is possible to cause the condensed water collected through the water discharge channel 140 to smoothly flow to the through-hole 43 on which the duct fastening part 200 is installed.

Figure 9:
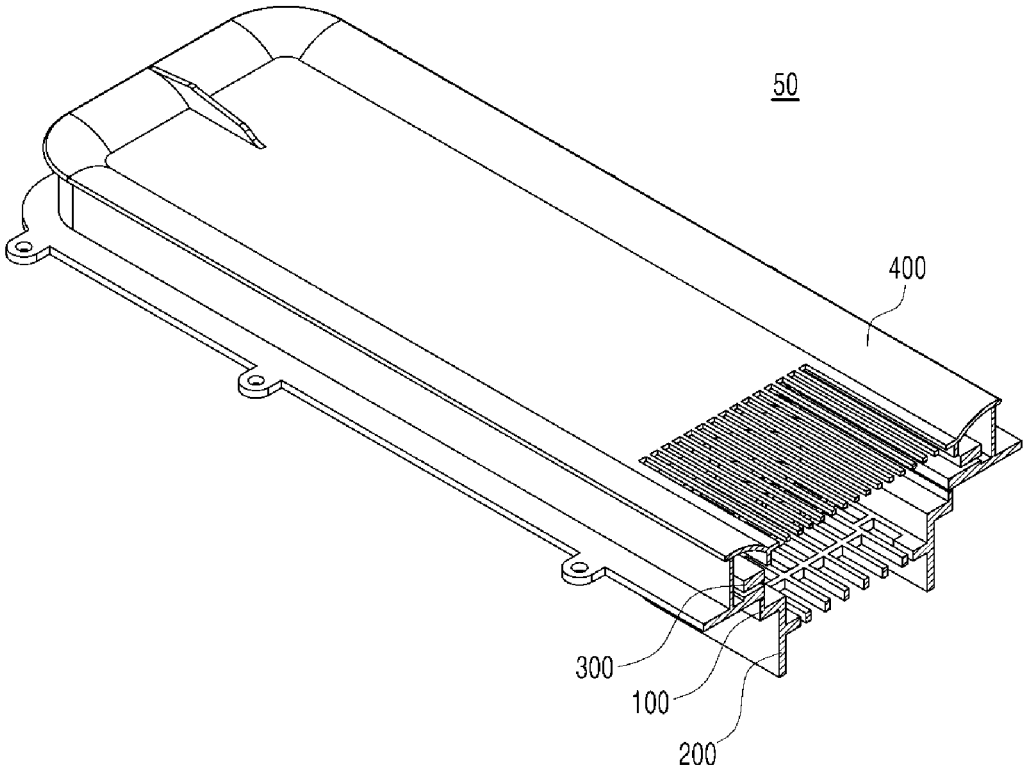
FIG. 9 is a cutaway view of the air inlet assembly illustrated in FIG. 4.
Figure 10:
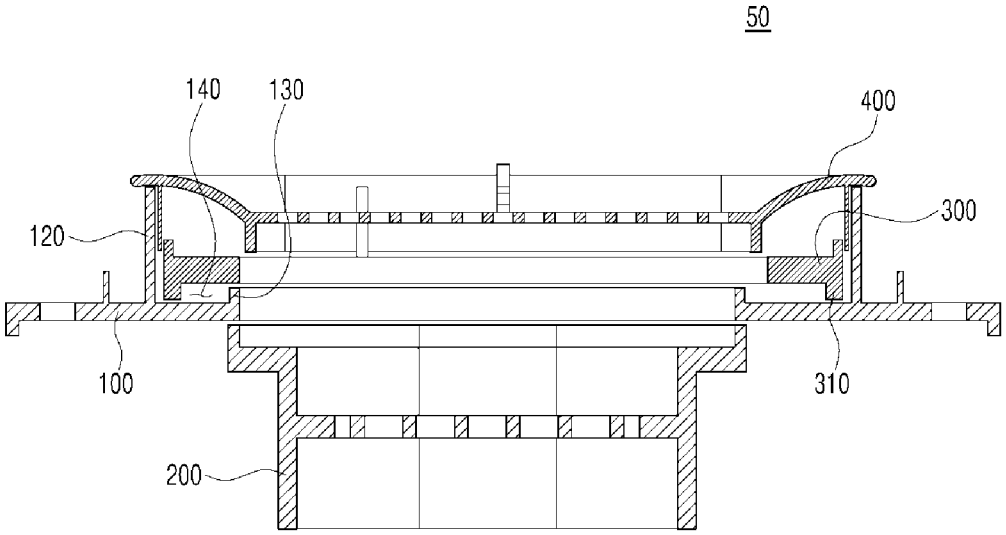
FIG. 10 is a cross-sectional view illustrating an assembled state of an air inlet assembly in a laundry treatment apparatus according to one embodiment of the present disclosure.
Figure 11:
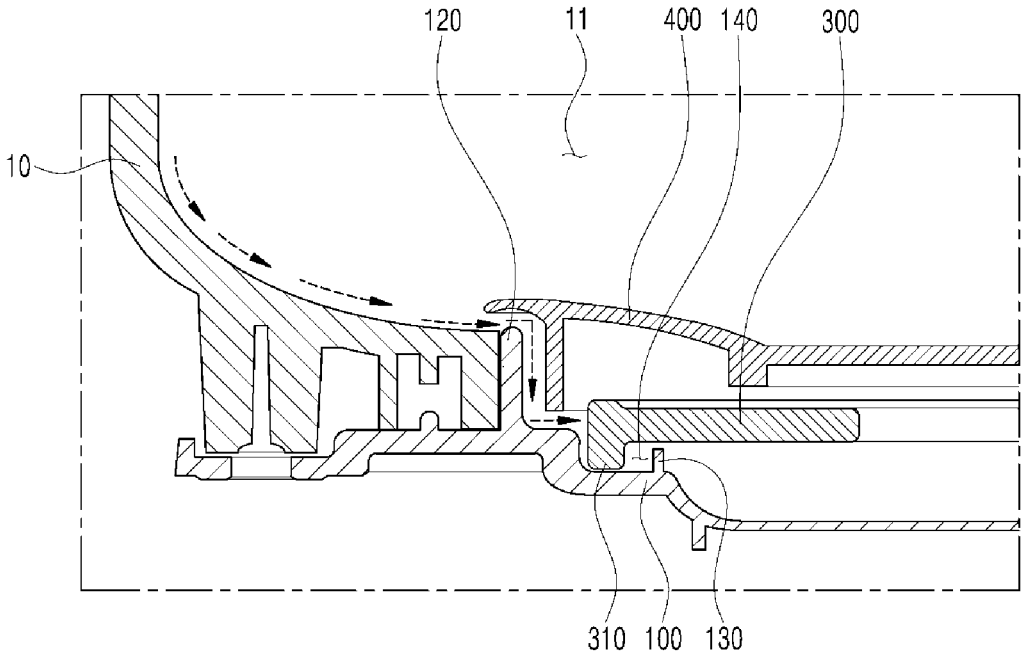
FIG. 11 is a view illustrating a path through which condensed water flows into an air inlet assembly in a laundry treatment apparatus according to one embodiment of the present disclosure.

FIG. 9 is a cutaway view of the air inlet assembly illustrated in FIG. 4. FIG. 10 is a cross-sectional view illustrating an assembled state of the air inlet assembly in the laundry treatment apparatus according to one embodiment of the present disclosure. FIG. 11 is a view illustrating a path through which condensed water flows into the air inlet assembly in the laundry treatment apparatus according to one embodiment of the present disclosure.

In the air inlet assembly 50 and the laundry treatment apparatus 1000 including the same according to one embodiment of the present disclosure, the filter 300 may include a support 310 extending along the water discharge channel 140 and supported by the cover 100.

That is, as illustrated in FIG. 10, the support 310 is formed under the filter 300, such that the filter 300 may be stably mounted on the cover 100 by the support 310. In this case, the support 310 may extend along the water discharge channel 140 formed in the cover 100, such that the support may be stably mounted in the water discharge channel 140.

Accordingly, some of the condensed water flowing into the water discharge channel 140 may flow along the surface of the support 310, and the extension direction of the support 310 may guide the flow direction of the condensed water.

As described above, in the air inlet assembly 50 and the laundry treatment apparatus 1000 including the same according to one embodiment of the present disclosure, since the support 310 for the filter 300 extends along the water discharge channel 140, the support 310 may guide a flow path of the condensed water flowing into the water discharge channel 140.

In the air inlet assembly 50 and the laundry treatment apparatus 1000 including the same according to one embodiment of the present disclosure, the grill 400 may be stably mounted on the outer wall 120 to be supported by the cover 100.

That is, as illustrated in FIG. 11, the outer end of the grill 400 may be stably mounted on the outer wall 120 of the cover 100. Accordingly, the condensed water flowing along the inner surface of the cabinet 10 may flow to the cover 100, and may then come into contact with the gap between the grill 400 and the outer wall 120.

In this case, since a relatively small gap exists between the grill 400 and the outer wall 120, the condensed water coming into contact with the gap may flow into the gap through a capillary phenomenon. Accordingly, although the outer wall 120 protrudes higher to some extent than the inner surface of the cabinet 10 as described above, the condensed water may smoothly flow into the water discharge channel 140 through the capillary phenomenon.

As described above, in the air inlet assembly 50 and the laundry treatment apparatus 1000 including the same according to one embodiment of the present disclosure, since the grill 400 is coupled to the outer wall 120 to be supported by the cover 100, it is possible to cause the condensed water generated in the receiving space 11 to flow into the gap between the grill 400 and the outer wall 120 through the capillary phenomenon.

In the air inlet assembly 50 and the laundry treatment apparatus 1000 including the same according to one embodiment of the present disclosure, the top surface of the grill 400 is inclined downward toward the inside of the air inlet assembly 50.

That is, as illustrated in FIGS. 9 and 10, both edges of the grill 400 may be inclined toward the inside of the air inlet assembly 50. Accordingly, even when the condensed water is present on the top surface of the grill 400, the condensed water may flow to the center of the grill 400 along the slope thereof, and may then flow to the through-hole 43 via the slits of the grill 400.

As described above, in the air inlet assembly 50 and the laundry treatment apparatus 1000 including the same according to one embodiment of the present disclosure, since the top surface of the grill 400 is formed to be recessed toward the inside of the air inlet assembly 50, it is possible to collect the condensed water present on the top surface of the grill 400 into the center of the grill 400 and then discharge the collected condensed water.

While the present disclosure has been explained in relation to its preferred embodiments, it is to be understood that various modifications thereof will become apparent to those skilled in the art upon reading the specification. Therefore, it is to be understood that the disclosure disclosed herein is intended to cover such modifications as fall within the scope of the appended claims.

What is claimed is:

1. A laundry treatment apparatus comprising:

a cabinet defining a receiving space configured to receive laundry;

an air supply device configured to generate air to be circulated in the receiving space;

an air supply part configured to supply air from the air supply device to the receiving space;

an air suction part defining a through-hole at a portion thereof, wherein the air suction part is configured to remove air, including one or more of foreign substances or water contained in the air, from the receiving space through the through-hole; and an air inlet assembly comprising a cover disposed at the air suction part, wherein the cover comprises:

a base plate that covers the air suction part and defines an opening corresponding to the through-hole, an outer wall protruding along a periphery of the base plate, and a rib protruding from an inner portion on the base plate and spaced apart from the outer wall so as to form a water discharge channel in a space between the outer wall and the rib, wherein the water discharge channel extends toward the through-hole, wherein condensed water generated in the receiving space is discharged through the through-hole of the air suction part.

2. The laundry treatment apparatus of claim 1, wherein the water discharge channel is inclined downward toward the through-hole.

3. The laundry treatment apparatus of claim 2, wherein the cover further comprises a slope inclined upward from a coupling point between the water discharge channel and the through-hole.

4. The laundry treatment apparatus of claim 3, wherein the base plate has a rectangular shape and the through-hole is disposed at one end thereof, and wherein the water discharge channel extends from the other end of the base plate toward the through-hole.

5. The laundry treatment apparatus of claim 4, wherein a protruding height of the rib is less than a protruding height of the outer wall.

6. The laundry treatment apparatus of claim 1, wherein the air inlet assembly further comprises a duct fastening part that is coupled to the cover and covers the through-hole.

7. The laundry treatment apparatus of claim 6, wherein the duct fastening part comprises a water discharge groove recessed at a coupling point between the duct fastening part and the water discharge channel.

8. The laundry treatment apparatus of claim 7, wherein the air inlet assembly further comprises a filter disposed on the cover, wherein the filter is configured to filter foreign substances introduced into the air suction part.

9. The laundry treatment apparatus of claim 8, wherein the filter comprises a support extending along the water discharge channel and supported by the cover.

10. The laundry treatment apparatus of claim 9, wherein the air inlet assembly further comprises a grill that is coupled to the cover and covers the filter.

11. The laundry treatment apparatus of claim 10, wherein the grill is disposed on the outer wall and supported by the cover.

12. The laundry treatment apparatus of claim 11, wherein a top surface of the grill is inclined downward toward an inside of the air inlet assembly.

13. The laundry treatment apparatus of claim 1, wherein the air supply device is configured to dehumidify and heat air to thereby supply dry and hot air to the receiving space.

14. The laundry treatment apparatus of claim 1, further comprising a water generation device configured to supply steam to the receiving space.

15. The laundry treatment apparatus of claim 14, further comprising a condensed water discharge device configured to collect and discharge condensed water generated in the receiving space and the air supply device.

16. The laundry treatment apparatus of claim 15, wherein the condensed water discharge device is configured to supply the condensed water back to the water generation device.

17. The laundry treatment apparatus of claim 1, further comprising a controller configured to control individual components of the laundry treatment apparatus.

18. The laundry treatment apparatus of claim 14, wherein the cabinet defines a machine room that is separate from the receiving space, the machine room containing the air supply device and the water generation device.

19. The laundry treatment apparatus of claim 18, wherein the machine room is disposed below the receiving space.

* * * * *